United States Patent [19]

Rogers, Jr.

[11] Patent Number: 4,707,025

[45] Date of Patent: Nov. 17, 1987

[54] ROCKER RECLINER

[75] Inventor: Walter C. Rogers, Jr., Denton, N.C.

[73] Assignee: Parma Corporation, Denton, N.C.

[21] Appl. No.: 878,702

[22] Filed: Jun. 26, 1986

[51] Int. Cl.[4] ..... A47C 3/02

[52] U.S. Cl. ..... 297/259; 297/83; 297/85; 297/316; 297/DIG. 7

[58] Field of Search ..... 297/83, 84, 85, 86, 297/90, 91, 316, 320, 321, 340, 269, 270, 259, 271, DIG. 7

[56] References Cited

U.S. PATENT DOCUMENTS

| | | | |
|---|---|---|---|
| 3,069,201 | 12/1962 | Belisle et al. | 297/316 X |
| 3,166,353 | 1/1965 | Re | 297/83 X |
| 3,550,952 | 12/1970 | Ferguson | 297/85 |
| 3,572,823 | 3/1971 | Hampton | 297/83 X |
| 3,730,585 | 5/1973 | Rogers, Jr. et al. | 297/85 |
| 3,869,172 | 3/1975 | James et al. | 297/316 |
| 4,071,275 | 1/1978 | Rogers, Jr. | 297/85 |
| 4,077,663 | 3/1978 | Cycowicz et al. | 297/83 |
| 4,108,491 | 8/1978 | Rogers, Jr. | 297/85 |
| 4,519,647 | 5/1985 | Rogers, Jr. | 297/DIG. 7 |

FOREIGN PATENT DOCUMENTS

| | | | |
|---|---|---|---|
| 863490 | 3/1961 | United Kingdom | 297/316 |

*Primary Examiner*—James T. McCall

*Attorney, Agent, or Firm*—William E. Mouzavires

[57] ABSTRACT

A rocker-recliner chair utilizing but two mounting links for mounting the seat and backrest to the rocker cams and which mounting links are also utilized to position the chair in advanced reclining positions beyond the TV position. The chair is biased to the TV position wherein the footrest is extended, by the weight of the chair occupant acting through the rear mounting link. However, the chair is retained in upright position against the gravity basis by a spring-loaded lock mechanism which is actuated by a handle to release the lock mechanism to allow the occupant's weight to drive the chair to TV position. When moving to TV position, the seat undergoes a certain amount of rearward displacement relative to the rocking cams to position the weight of the occupant to the rear while a "landing gear" stop descends to engage the base to thus prevent rearward rocking of the chair. In the preferred embodiment where the backrest is pivoted for movement relative to the seat to obtain advanced reclining positions, a sequencer link prevents movement of the backrest relative to the seat until the chair reaches TV position. This sequencer link also serves the important purpose of reinforcing the linkage system.

24 Claims, 4 Drawing Figures

ROCKER RECLINER

BACKGROUND OF INVENTION

Three-way recliner chairs are typically equipped with at least two links mounting the seat and backrest assembly on the base for movement to TV position and beyond into advanced reclining positions. See, for example, U.S. Pat. No. 3,730,585 to Rogers. In some cases, the seat and backrest are mounted to a carrier link which, in turn, is mounted or suspended from a base. See, for example, U.S. Pat. Nos. 4,108,491 and 4,071,275 to Rogers. Additionally included in such chairs of the prior art is a backrest linkage which mounts the backrest to the seat and/or base while also serving to place the chair into advanced reclining positions upon application of pressure to the backrest when the chair is in or beyond TV position.

Reduction of the number of links in recliner chair mechanisms to reduce manufacturing costs is an ever-present goal in the industry. However, in many instances, such reduction is not attainable because it results in a sacrifice of performance of the chair and/or a weakening of the structural strength of the linkage mechanism.

As will be seen below, the present invention is addressed to integrating the mounting and backrest links in a three-way recliner chair to minimize the number of links required to achieve the functions of these parts and yet, without sacrificing quality of performance or the strength of the linkage mechanism.

OBJECTS OF INVENTION

An object of the present invention is to provide a novel and improved three-way recliner chair having a linkage system wherein the seat mounting links and the reclining links are integrated to simplify and reduce the number of links without sacrificing performance of the chair. Included herein is a novel linkage system particularly suitable for a rocker-recliner chair although it need not be limited thereto.

A further object of the present invention is to provide a novel linkage system for a rocker-recliner chair which system utilizes but two links for mounting the seat and backrest relative to the rocker cams and yet will ahcieve satisfactory, if not improved reclining performance without suffering structural failure.

Another object of the present invention is to provide a rocker-recliner chair as well as a linkage system for such a chair which comfortably positions the chair occupant in reclining positions while minimizing the tendency of the chair to lurch or rock forward while in reclined positions.

Another object of the present invention is to provide such a recliner-chair-linkage system which may be manufactured at commercially feasible cost without sacrificing quality of performance or strength and durability of construction.

SUMMARY OF INVENTION

In the preferred embodiment, the present invention is applied to a rocker-recliner chair by utilizing only two links for mounting the seat and backrest to the rocker cams and without utilizing any intermediate links such as carrier links heretofore employed in recliner chairs. The aforementioned mounting links are also connected to the backrest link to enable advanced reclining positions to be achieved after the chair is placed into TV position; the latter being achieved through the weight of the chair occupant acting downwardly through the rear mounting link to move a drive link connected to the footrest linkage. A slotted sequencer link between the backrest link and the drive link prevents movement of the backrest relative to the seat until the chair is in TV position. This sequencer link also serves an important function to reinforce the backrest link against structural failure. Movement of the chair to TV position causes a "landing gear" stop mechanism to descend into engagement with the chair base to prevent rocking of the chair. Additionally, such movement displaces the seat rearwardly relative to the rocking cams to position the occupant's weight towards the rear to prevent forward lurching or rocking of the chair.

DRAWINGS

Other objects and advantages of the present invention will become apparent from the following more detailed description taken in conjunction with the attached drawings in which.

DETAILED DESCRIPTION

Figure 1:
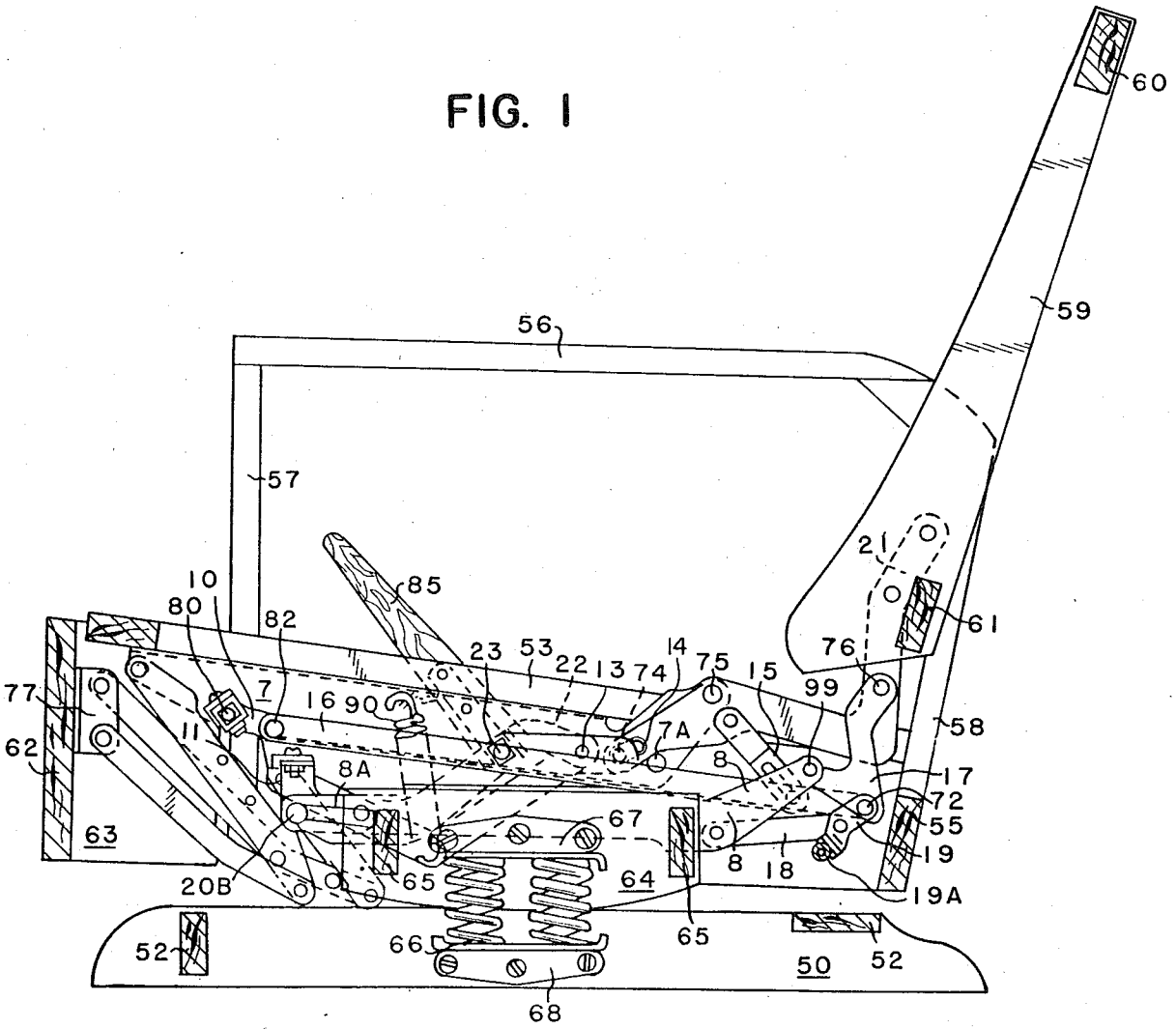
FIG. 1 is a side-elevational view of a rocker-recliner chair representing a preferred embodiment of the present invention with the chair being shown in generally upright or closed position and in cross section with the upholstery removed.

Referring now to the drawings in detail, there is shown, for illustrative purposes only, a rocker-recliner chair constituting a preferred embodiment of the present invention. Included is a typical base comprised of side rails 50 and cross rails 52, and rocker cams 64 mounted on the base as shown in FIG. 1 as are the springs 66 bearing between plates 67 and 68 fixed to the rocker cams and base 50 respectively. As will be explained in greater detail below, the seat and backrest assembly is mounted to the rocker cams for rocking and reclining movement. The frame of the seat includes opposite side rails 53 (one shown in FIG. 1) and armrests fixed to the seat and comprised of elements 55, 56, 57 and 58. The frame of the backrest includes vertical rails 59 (one shown) and cross pieces 60 and 61. The frame of the footrest is shown at 62 and 63.

Figure 2:
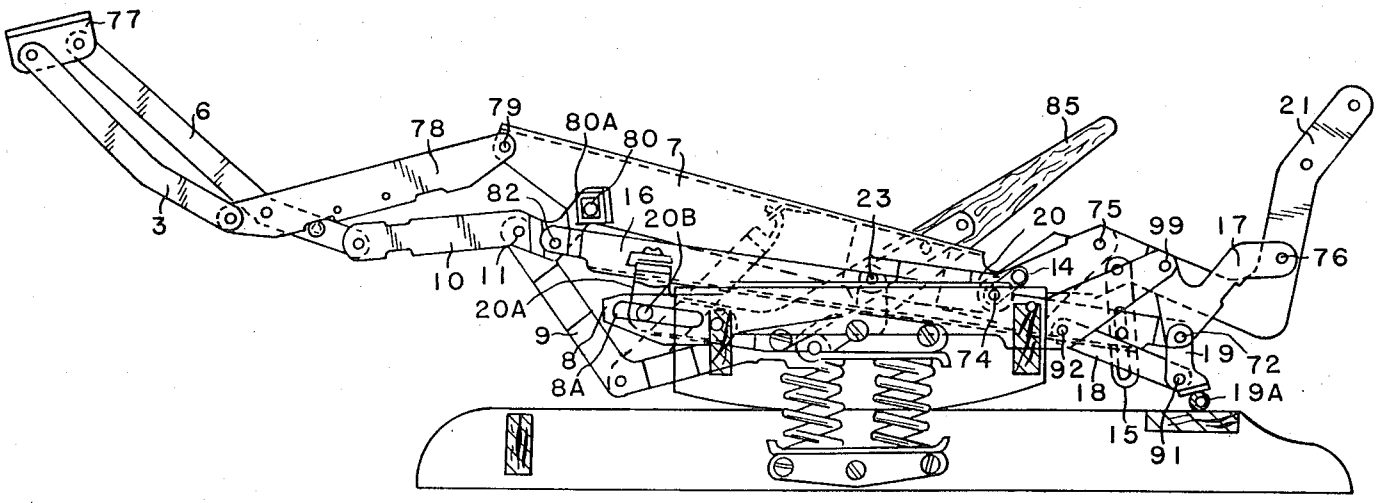
FIG. 2 is a view generally similar to FIG. 1 but when the chair is in TV position.
Figure 3:
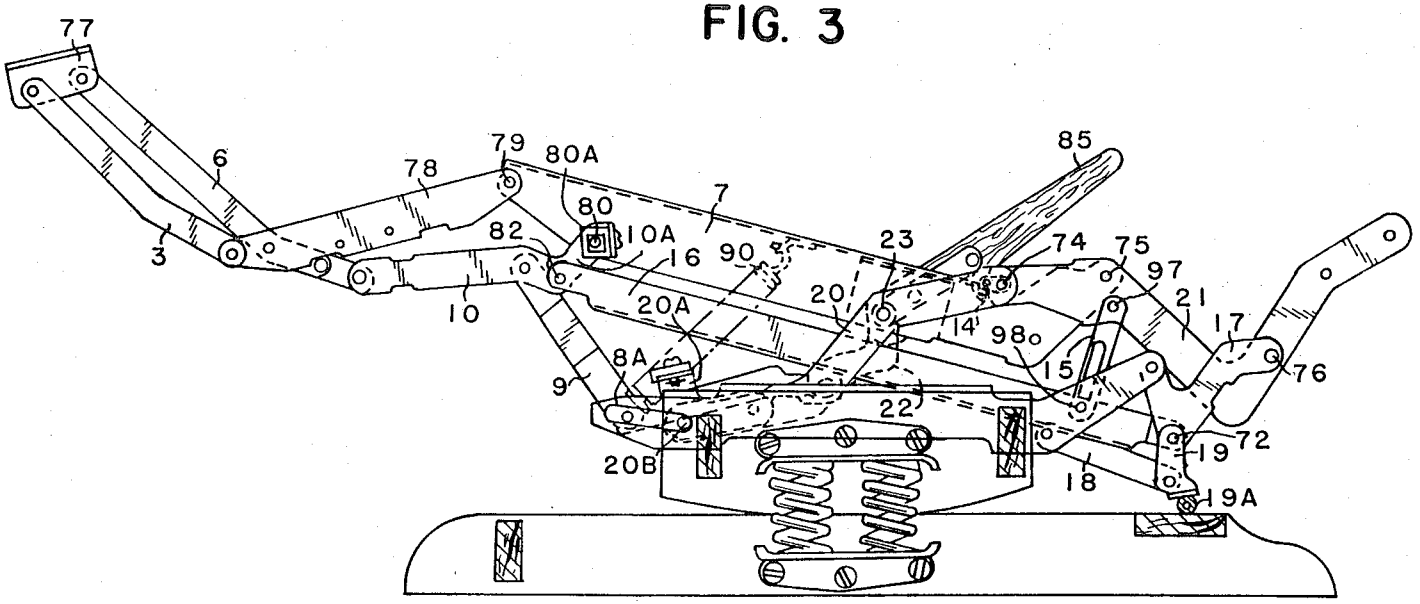
FIG. 3 is a view generally similar to FIG. 2 but when the chair is in a fully reclined position.

The linkage mechanism which mounts the aforementioned parts to the rocker cams includes an elongated seat link 7 fixed to the underside of the seat rail 53. An elongated cam link 8 is fixed to the rocker cam 64 and projects from the opposite ends thereof with the forward end of the cam link having an elongated slot 8A. The backrest is mounted to the seat through means of a backrest link 21 fixed to the backrest. The seat and backrest assembly are mounted to the rocker cam by front and rear mounting links 20 and 17. Front mounting link 20 is pivotally mounted to the seat link 7 by pivot 23 and to the cam link 8 by pivot 20B received in the slot 8A of the cam link. For manufacturing purposes, the lower end of mounting link 20 is provided with an extension 20A fixed thereto and containing the pivot 20B received in the slot 8A of cam link 8. Referring to FIG. 3, the upper and rearward end of front mounting link 20 is pivotally connected directly to the forward end of backrest link 21 by means of pivot 74 which is received in slots 14 formed in the ends of links 20 and 21 to accommodate the arcs of travel of links 20 and 21. Referring to FIGS. 1 and 2, the rear mounting link 17 is pivotally connected to cam link 8 at pivot 99 and to backrest link 21 at pivot 76. Rear mounting link 17 is also pivotally connected to a "landing gear" linkage 18 and 19 at pivot 72 to drive the landing gear stop in the form of a cross tube 19A downwardly to engage the base as shown in FIG. 2 when the chair is moved to TV position shown in FIG. 2. Landing gear links 18 and 19 are pivotally interconnected at pivot 91 while link 18 is pivotally mounted to cam link 8 at pivot 92.

Figure 4:
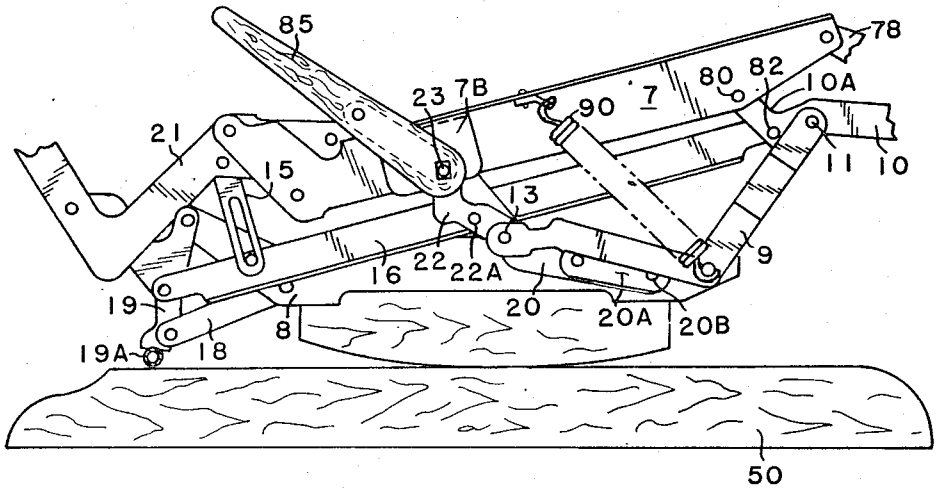
FIG. 4 is a view generally similar to FIG. 3 but as seen from the opposite side thereof and with certain parts removed.

The weight of the chair occupant acting downwardly in the chair when in closed or upright position as shown in FIG. 1, imposes a clockwise (as viewed in FIG. 1) bias on rear mounting link 17 which is transmitted forwardly through an elongated drive link 16 pivotally connected to rear mounting link 17 at pivot 72. The forward end of drive link 16 is pivotally connected to the footrest drive link 10 at pivot 82 for the purposes of driving the footrest to the extended TV position. However, a locking link 9 is provided to prevent extension of the drive link 16 by rear mounting link 17 when the chair is in the closed or upright position shown in FIG. 1. Locking link 9 has its forward end pivotally connected to footrest drive link 10 at pivot 11 and its rear end pivotally connected to a bell crank link 22 at pivot 13 as shown in FIGS. 1 and 4. An overcenter tension coil spring 90, anchored at one end to seat link 7, is attached to locking link 90 to bias the locking link 90 into the position shown in FIG. 1 to prevent movement of the drive link 16 and, in turn, extension of the footrest as long as the chair is in the closed or upright position shown in FIG. 1.

In order to release the holding effect of the locking link 9 to permit the chair to move to TV position of FIG. 2 from the closed position of FIG. 1, it is necessary to rotate the bell crank 22 about its pivotal mounting at 22A to drive link 16 as shown in FIG. 4. This is achieved through a handle 85 mounted on one side of the chair relative to seat link 7 at the same pivot assembly 23 which mounts the front mounting link 20 to the seat link 7. The handle has a shaft of square cross section rigidly fixed thereto at right angles to which shaft the upper end of bell crank 22 is rigidly bolted. The handle shaft is received onto a pin-like sleeve which is part of the pivot which connects the front mounting link 20 to the seat, and the handle shaft is thus captured between seat link 7 and an outrigger plate 7B mounted on seat link 7.

In order to transfer the motion of the footrest link 10 to the linkage system (not shown) on the opposite side of the chair, the footrest link 10 is provided with a crank portion **10*a* projecting beyond the location of pivot 82 and pivotally connected to seat link 7 at pivot 80 as best shown in FIGS. 3 and 4. As shown in FIG. 3, a square torque tube 80A is fixed to crank portion 10 and extends across to the other side of the chair where it is fixed to a crank of footrest link 10 corresponding to 10*a* to thus transmit motion to the latter and its associated footrest linkage to drive the same to TV position when the locking link 90 is released by actuating handle 85 as described above. Due to the fact that the pivot 80 is close to the line of force through the drive link 16 between pivots 72 and 82, the crank portion 10*a* of the footrest link 100 will possess sufficient mechanical advantage over the rear mounting link 17 to require only a single locking link 9** for the linkage system on one side of the chair.

The remaining portions of the footrest linkage are conventional and include another footrest mounting link 78 pivotally mounted to the front of seat link 7 at pivot 79 generally parallel to footrest link 10, and a second pair of generally parallel links 3 and 6 both pivotally connected at one end to a footrest bracket 77 and at the other end to link 78. Link 6 is also pivotally connected to link 10. The footrest bracket 77 is fixed to the footrest frame 62 as shown in FIG. 1.

In order to prevent the backrest from moving relative to the seat when the chair is in the closed or upright position of FIG. 1 and until it is moved towards the TV position of FIG. 2, a sequencing link 15 is pivotally connected to backrest link 21 at pivot 97 while its opposite end is pivotally received about a pivot 98 on the drive link 16 through means of a slot formed in the sequencing link 15 as shown in FIG. 3. Sequencing link 15 provides another very important function in acting as a reinforcing strut to prevent structural failure of the backrest link 21 due to the forces imparted to it from the rear mounting link 17.

To summarize the operation of the chair and assuming that the chair is occupied in the closed or upright position shown in FIG. 1, in order to move into the TV position, the occupant merely grasps handle 85 and pivots it clockwise into the position shown in FIG. 2. This actuation will move the crank 22 and, in turn, the locking member 9 to release the drive link 16 to unfold the footrest link 10 and the associated footrest linkage into the TV position shown in FIG. 2. The force for so driving link 16 emanates from the occupant's weight acting downwardly to pivot rear mounting link 17 clockwise from the position shown in FIG. 1 to the position shown in FIG. 2. During this phase of movement, the seat undergoes translational as well as rotational movement relative to the rocker cams to displace the seat rearwardly of the rocker cams to more firmly plant the rear of the chair down against the base to overcome forward rocking tendency when the occupant's legs are extended while the chair is in TV position. In addition, during the movement to TV position, rear mounting link 17 will actuate the landing gear assembly to position its stop 19A on the base to prevent rearward rocking of the chair.

In order to move the chair beyond TV position into advanced reclining positions, the occupant applies pressure to the backrest to pivot backrest link 21 relative to the seat about pivot 75 which pushes rear mounting link 17 downwardly and, in turn, the rear end of drive link 16 downwardly about pivot 82. Note that the aforementioned movement is permitted by the sequencing link 15 because, in the TV position, the pivot 98 which rides in the sequencing link slot is located approximately midway in the slot. During the aforementioned movement into advanced reclining positions, the bell crank end of the rear mounting link 17, which is pivoted to the rear of the cam link 8, is controlled so that the position of the system relative to the cams is controlled. In addition, during the aforementioned advanced reclining movement, the landing gear assembly 18 and 19 pushes downwardly against the base through its stop 19A which elevates the rear of the seat through motion about pivot 76. Simultaneously, the front portion of backrest link 21, through its slotted pivotal connection with front mounting link 20 has caused the latter to rotate about its pivot 23 to push the front of the rocker cam downwardly at the slidable connection between link 20 and cam link 8. The occupant's weight remains to the rear of the direction in which the cams have a tendency to rock. However, if preferred and although not shown, a device for preventing forward rocking may be added. During the movement beyond TV into advanced reclining positions, the movement takes place through a four-bar linkage between pivots 82, 75, 76 and 72.

In order to return the chair to TV position, the occupant merely has to relieve pressure from the backrest since the linkage system will find its balance through an infinite number of positions between TV position shown in FIG. 2 and the fully reclined position shown in FIG. 3. In order for the occupant to return the chair from TV position to the fully upright position, he merely needs to retract the footrest by applying pressure with his legs to overcome the biasing force of the occupant's weight and spring 90. Once the chair is returned to the closed position shown in FIG. 1, the locking member 9, biased by spring 90, will retain it in this position until such time as the handle 85 is actuated to release the hold of locking member 9.

It will thus be seen that with the present invention the mounting links 20 and 17 serve dual functions, merely to mount the seat and backrest relative to the base and also to provide a reclining linkage through which advanced reclining beyond TV position is achieved. In this way, an important goal of reducing the number of links is acchieved without sacrificing quality of performance or structural strength in the linkage system. Moreover, with the present invention, the seat is mount by the linke 17 and 20 directly to the base and does away with the need of an intermediate carrier link heretofore emplyed in some recliner mechanisms.

Although the invention has been shown and described above in connection with a preferred embodiment as applied to a rocker-recliner, it will be apparent to those skilled in the art that the invention may be applied to other types of recliner chairs without departing from the scope of the present invention which appears in the following claims.

What is claimed is:

1. In a three-way recliner chair including a base, and a seat and backrest assembly including a seat and backrest, a linkage system for mounting the seat relative to base and the backrest relative to the seat for movement between a generally upright position and a reclined position, the linkage system including a backrest link fixed to the backrest and pivotally connected to the seat, a front mounting link pivoted intermediate its ends to the seat at a first location while also being pivoted directly to the backrest link at a second location spaced from said first location, means pivotally interconnecting the front mounting link and the base at a third location spaced from said first location on one side of said first location opposite said second location while permitting translation of the front mounting link relative to the base, and a rear mounting link located rearwardly of the front mounting link and pivotally connected to the backrest link and the base.

2. The reclining chair defined in claim 1 wherein said rear mounting link is directly connected to the backrest link and the base.

3. The reclining chair defined in claim 1 wherein the base includes rocker cams for rocking the seat.

4. The reclining chair defined in claim 1, said means pivotally interconnecting the front mounting link and the base includes a slot and a pivot pin in the slot.

5. The reclining chair defined in claim 1 further including means including a slot pivotally interconnecting the front mounting link and the backrest link while allowing relative translational movement between the front mounting link and the backrest link.

6. The reclining chair defined in claim 4 further including means including a slot pivotally interconnecting the front mounting link and the backrest link while allowing relative translational movement between the front mounting link and the backrest link.

7. The reclining chair defined in claim 1 further including a footrest linkage connected to the seat and a drive link pivotally interconnected between the footrest linkage and the rear mounting link for driving the footrest linkage to an extended position in response to movement of said rear mounting link.

8. The reclining chair defined in claim 7 further including sequencing means pivotally interconnected between said backrest link and drive link to prevent movement of the backrest relative to the seat until said footrest linkage is moved towards extended position.

9. The recliner chair defined in claim 6 further including a footrest linkage and a drive link pivotally interconnected between the footrest linkage and the rear mounting link for driving the footrest linkage to an extended position in response to movement of said rear mounting link.

10. The recliner chair defined in claim 9 further including sequencing means pivotally connected to and between said backrest and drive links to prevent movement of the backrest relative to the seat until said footrest linkage is moved toward extended position, said sequencing means also serving to reinforce the linkage system.

11. In a three-way reclining chair including a base, and a seat and backrest, a linkage system for mounting the seat and backrest relative to the base for movement between a generally upright position and a reclined position, the linkage system including a footrest linkage connected to the seat and movable between extended and retracted positions, a backrest link fixed to the backrest and pivotally connected to the seat, a front mounting link pivotally connected to the seat at a first location intermediate the ends of the front mounting link while also being pivotally connected to the backrest link at a second location spaced from said first location, means pivotally interconnecting the front mounting link and the base at a third location spaced from said first location on one side of said first location opposite said second location while permitting translation of the front mounting link relative to the base, a rear mounting link pivotally connected to the backrest link and the base, and a drive link having a rear end pivotally connected to the rear mounting link to be driven thereby and having a front end pivotally connected to the footrest linkage to drive the same, and a sequencing link pivotally interconnecting said backrest and drive links to prevent movement of the backrest relative to the seat until the footrest linkage is moved towards extended position, said sequencing link also serving to reinforce the linkage system.

12. The chair defined in claim 11 wherein when the footrest linkage is extended, application of pressure against the backrest will pivot backrest link about its connection to the seat and will push rear mounting link downwardly to pivot the drive link downwardly about its pivotal connection to the footrest linkage to thereby place the chair in an advanced reclining position.

13. The recliner chair defined in claim 12 wherein said seat moves rearwardly relative to said base when the footrest linkage is moved to extended position.

14. The chair defined in claim 12 wherein said base has a slot and said front mounting link is pivotally received in said slot.

15. The chair defined in claim 14 wherein said front mounting link and said backrest link are interconnected to allow translational movement therebetween.

16. The chair defined in claim 15, wherein the rear mounting link is biased by the weight of the occupant to actuate the drive link to extend the footrest linkage, and wherein there is further included a lock means for preventing movement of the drive link, and means for releasing the drive link to allow the footrest linkage to be moved to extended position.

17. For use in a three-way reclining chair including a base, and a seat and backrest assembly including a seat and backrest; a linkage system for mounting the seat relative to the base and the backrest relative to the seat for movement between a generally upright position and a reclined position, the linkage system including a seat link adapted to be connected to a seat, a backrest link adapted to be fixed to a backrest and pivotally connected to the seat link a front mounting link pivoted intermediate its ends at a first location to the seat link while also being pivoted directly to the backrest link at a second location spaced from said first location, a base link adapted to be mounted to a base, means pivotally interconnecting the front mounting link and the base link at a third location spaced from said first location on one side of said first location opposite the second location while permitting translation of the front mounting link relative to the base link rearwardly of the front mounting link and pivotally connected directly to the backrest link and pivotally connected to the base link.

18. The linkage system defined in claim 17 wherein said means includes a slot and a pivot pin in the slot.

19. The linkage system defined in claim 18 further including a footrest linkage connected to the seat link and a drive link pivotally interconnected between the footrest linkage and the rear mounting link for driving the footrest linkage to an extended position in response to movement of said rear mounting link.

20. The linkage system defined in claim 19 further including a sequencing link pivotally connected to said drive link and said backrest link to prevent movement of the backrest link relative to the seat link until said footrest linkage is moved towards extended position.

21. For use in a three-way reclining chair including a base, and a seat and backrest; a linkage system for mounting the seat and backrest relative to the base for movement between a generally upright position and a reclined position, the linkage system including a seat link adapted to be connected to a seat, a footrest linkage connected to the seat link and movable between extended and retracted positions, a backrest link adapted to be fixed to the backrest and pivotally connected to the seat link, a front mounting link pivoted intermediate its ends to said seat link at a first location while being pivoted to the backrest link at a second location spaced from said first location, a base link adapted to be mounted to a base, means pivotally interconnecting the front mounting link and the base link at a third location spaced from said first location on one side of said first location opposite said second location while permitting translation of the front mounting link relative to the base link, a rear mounting link pivotally connected to the backrest link and pivotally connected to the base link, a drive link having a rear end pivotally connected to the rear mounting link to be driven thereby and having a front end pivotally connected to the footrest linkage to drive the same, and a sequencing link pivotally interconnecting said backrest and drive links to prevent movement of the backrest link relative to the seat link until the footrest linkage is moved towards extended position, said sequencing link also serving to reinforce the linkage system.

22. The linkage system defined in claim 21 wherein said base link has a slot, and wherein said front mounting link is pivotally received in said slot.

23. The linkage system defined in claim 22 wherein said front mounting link and said backrest link are interconnected through a slot to allow translational movement therebetween.

24. The linkage system defined in claim 23 further including lock means for preventing movement of the drive link, and means for releasing the drive link to allow the footrest linkage to be moved to extended position.

* * * * *